US010238194B2

(12) United States Patent
Turpeau

(10) Patent No.: US 10,238,194 B2
(45) Date of Patent: Mar. 26, 2019

(54) TOTE BAG

(71) Applicant: Alem Turpeau, Atlanta, GA (US)

(72) Inventor: Alem Turpeau, Atlanta, GA (US)

(73) Assignee: Alem Turpeau, Atlanta, GA (US)

( * ) Notice: Subject to any disclaimer, the term of this patent is extended or adjusted under 35 U.S.C. 154(b) by 866 days.

(21) Appl. No.: 13/870,231

(22) Filed: Apr. 25, 2013

(65) Prior Publication Data

US 2014/0001001 A1 Jan. 2, 2014

Related U.S. Application Data

(60) Provisional application No. 61/641,354, filed on May 2, 2012.

(51) Int. Cl.

| | |
|---|---|
| ***A45C 7/00*** | (2006.01) |
| ***A45C 3/04*** | (2006.01) |
| ***A45C 5/14*** | (2006.01) |
| *A45C 3/00* | (2006.01) |

(52) U.S. Cl.

CPC ..... *A45C 7/0059* (2013.01); *A45C 3/04* (2013.01); *A45C 5/14* (2013.01); *A45C 5/143* (2013.01); *A45C 5/146* (2013.01); *A45C 7/0068* (2013.01); *A45C 7/0072* (2013.01); *A45C 2003/002* (2013.01)

(58) Field of Classification Search

CPC ..... A45C 5/14; A45C 13/262; A45C 5/146; A45C 13/385; A45C 3/004; A45C 7/00; A45C 7/0059; A45C 3/04

USPC ..... 190/18 A, 103, 105, 107, 104; 220/666, 220/6, 489, 382, 8; 224/153; D3/260, D3/279, 303

See application file for complete search history.

(56) References Cited

U.S. PATENT DOCUMENTS

| | | | | |
|---|---|---|---|---|
| 672,143 A * | 4/1901 | Boughner | ..... | A45C 7/0031 190/104 |
| 4,157,103 A * | 6/1979 | La Fleur | ..... | B65D 1/0292 141/338 |
| 4,254,850 A | 3/1981 | Knowles | | |
| 5,226,551 A * | 7/1993 | Robbins, III | ..... | B65D 1/0292 220/8 |

(Continued)

FOREIGN PATENT DOCUMENTS

| | | | |
|---|---|---|---|
| JP | 2002136320 A | * | 5/2002 |
| WO | 2013004863 A | | 1/2013 |

OTHER PUBLICATIONS

International Search Report, PCT/US2013/038240, filed Apr. 25, 2013.

*Primary Examiner* — Fenn C Mathew
*Assistant Examiner* — Cynthia Collado
(74) *Attorney, Agent, or Firm* — Landmark Intellectual Property Law, PLLC

(57) ABSTRACT

The present invention is generally directed to a vertically expanding tote bag or purse, formed from a substantially rigid bottom panel, an internal telescopic support connected to the bottom panel, a collapsible pocket connected to the solid bottom panel and the internal support, the collapsible pocket disposed such that it creates a collapsible cavity or pocket within the collapsible material when the internal support is telescoped into an extended position; and a non-collapsible pocket formed from non-collapsible side walls that form a cavity or pocket, the non-collapsible pocket attached to the internal support.

13 Claims, 21 Drawing Sheets

(56) References Cited

U.S. PATENT DOCUMENTS

| | | | | |
|---|---|---|---|---|
| 5,664,652 | A | 9/1997 | Shamah | |
| 6,179,176 | B1 | 1/2001 | Saggese et al. | |
| 7,036,699 | B1 * | 5/2006 | Hay | A61G 5/10 224/407 |
| 2005/0178630 | A1 | 8/2005 | Wu | |
| 2006/0213452 | A1 * | 9/2006 | King | A01K 1/0245 119/496 |
| 2007/0158005 | A1 * | 7/2007 | Mangano | A45C 3/06 150/127 |
| 2012/0267208 | A1 | 10/2012 | D'Angelo | |
| 2013/0200581 | A1 * | 8/2013 | Vanderberg | B62B 5/0083 280/30 |
| 2014/0262660 | A1 * | 9/2014 | D'Angelo | A45C 5/146 190/18 A |
| 2015/0182007 | A1 * | 7/2015 | Ponx | A45F 3/04 224/653 |

* cited by examiner

TOTE BAG

RELATED APPLICATIONS

This application is based upon U.S. Provisional Patent Application No. 61/641,354 filed on May 2, 2012.

BACKGROUND OF THE INVENTION

The present invention is generally directed to an improved tote bag or purse. More specifically, the present invention is directed to a purse or tote bag that is expandable to provide for additional storage and capabilities, and may be equipped with optional wheels, internal frames, or other attributes or components to increase maneuverability or stability of the tote bag or purse.

Certain jurisdictions are prohibiting the use of plastic bags at grocery stores and other retail outlets, in order to encourage customers to use reusable bags. Alternatively, some locations now charge per bag used by a customer. Accordingly, it is often prudent for a customer to keep a reusable bag with him or her, for the occasional unplanned trip to the store or errand. The use of reusable bags—and even plastic bags—can often be difficult if a customer has a large number of items and a distance to travel. While one or two plastic or reusable bags may be manageable, many more can often be too heavy or inconvenient, causing physical strain.

Since many people carry a purse, satchel, tote bag, briefcase, or other sort of bag, it would be advantageous to provide a bag that can be used for its typical purpose (for example, as a purse or a briefcase), but can also be altered to provide an additional storage area or capacity for the occasional use. Such occasional uses can be in the place of plastic or reusable bags, or may be merely to occasionally carry a larger amount of items than normal.

Vertically expandable luggage is known in the luggage industry and is often preferred due to its ability to adjust in height to match a user's selected comfortable height.

A tote bag, purse, briefcase, etc. that can be vertically expanded to carry the occasional additional items is desirable. Equipping such tote bag, purse, briefcase, etc. with optional or retractable wheels to assist in moving a larger load is also desirable.

SUMMARY OF THE INVENTION

Aspects in accordance with some embodiments of the present invention may include a vertically expanding bag, comprising: a substantially rigid bottom panel; an internal support connected to the bottom panel, the internal support capable of telescoping from a collapsed position to an extended position; a collapsible pocket connected to the solid bottom panel and the internal support, the collapsible pocket disposed such that it creates a collapsible cavity or pocket within the collapsible material when the internal support is telescoped into an extended position; and non-collapsible side walls that form a cavity or pocket, the non-collapsible side walls attached to the internal support.

Other aspects in accordance with some embodiments of the present invention may include a vertically expanding bag, comprising: a substantially rigid bottom panel, comprising: one or more cavities formed in the substantially rigid bottom panel; one or more wheels disposed inside the one or more cavities; and a mechanism to raise and lower the one or more wheels between positions inside the cavity and positions extending from the cavity, such that in an lowered position the wheels may be used; an internal support connected to the bottom panel, the internal support capable of telescoping from a collapsed position to an extended position; a collapsible pocket connected to the solid bottom panel and the internal support, the collapsible pocket disposed such that it creates a collapsible cavity or pocket within the collapsible material when the internal support is telescoped into an extended position; a non-collapsible pocket, comprised of: side walls that form a cavity or pocket, the non-collapsible side walls attached to the internal support; and a bottom surface separating the non-collapsing cavity or pocket from the collapsible pocket.

These and other aspects will become apparent from the following description of the invention taken in conjunction with the following drawings, although variations and modifications may be effected without departing from the spirit and scope of the novel concepts of the invention.

BRIEF DESCRIPTION OF THE DRAWING

The present invention can be more fully understood by reading the following detailed description together with the accompanying drawings, in which like reference indicators are used to designate like elements. The accompanying figures depict certain illustrative embodiments and may aid in understanding the following detailed description. Before any embodiment of the invention is explained in detail, it is to be understood that the invention is not limited in its application to the details of construction and the arrangements of components set forth in the following description or illustrated in the drawings. The embodiments depicted are to be understood as exemplary and in no way limiting of the overall scope of the invention. Also, it is to be understood that the phraseology and terminology used herein is for the purpose of description and should not be regarded as limiting. The detailed description will make reference to the following figures, in which.

Figure 1:
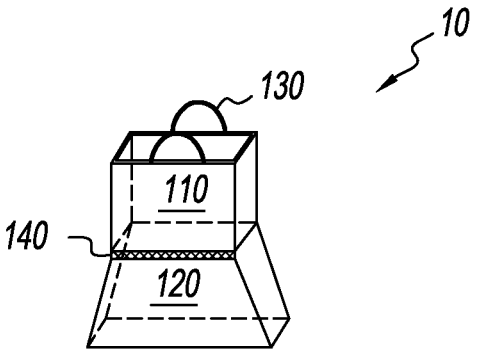
FIG. 1 illustrates an improved tote bag in a collapsed position, in accordance with some embodiments of the present invention.

Before any embodiment of the invention is explained in detail, it is to be understood that the present invention is not limited in its application to the details of construction and the arrangements of components set forth in the following description or illustrated in the drawings. The present invention is capable of other embodiments and of being practiced or being carried out in various ways. Also, it is to be understood that the phraseology and terminology used herein is for the purpose of description and should not be regarded as limiting.

DETAILED DESCRIPTION OF THE INVENTION

The matters exemplified in this description are provided to assist in a comprehensive understanding of various exemplary embodiments disclosed with reference to the accompanying figures. Accordingly, those of ordinary skill in the art will recognize that various changes and modifications of the exemplary embodiments described herein can be made without departing from the spirit and scope of the claimed invention. Descriptions of well-known functions and constructions are omitted for clarity and conciseness. Moreover, as used herein, the singular may be interpreted in the plural, and alternately, any term in the plural may be interpreted to be in the singular.

Note that while the present discussion often uses the phrase "tote bag," the present invention may be practiced with any variety of bags, including but not limited to: purses, briefcases, laptop bags, messenger bags, backpacks, totes, shopping bags, re-usable shopping bags, luggage, satchels, or any other sort of bag that is used to carry items.

With reference to FIG. 1, an exemplary tote bag 10 in accordance with some embodiments of the present invention will now be discussed. Tote bag 10 may comprise a top portion 110 and a bottom portion 120. Top portion 110 may comprise handles 120 (or alternatively, straps, shoulder straps, wrist strap, etc.). Moreover, tote bag 10 may comprise a joint 140 between the top portion 110 and the bottom portion 120. This joint 140 may be secured by a fastener, such as a zipper, buttons, snaps, hook-and-loop (e.g. Velcro), magnets, or any other sort of fastener. When joint 140 provides a connection from the top portion 110 to the bottom portion 120, the tote bag 110 may be in the collapsed position.

Figure 2:
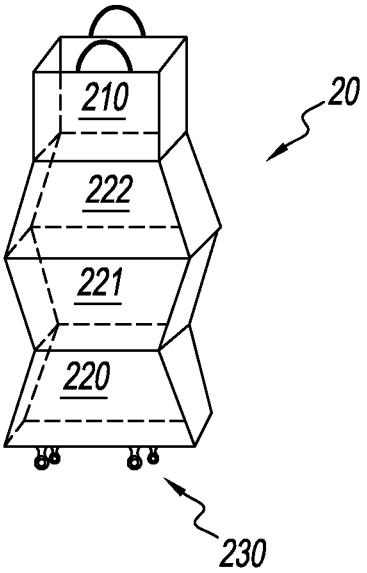
FIG. 2 illustrates an improved tote bag in an expanded position, in accordance with some embodiments of the present invention.

With reference to FIG. 2, a tote bag 20 may be seen in an expanded position. Tote bag 20 may comprise a top portion 210 and a bottom portion 220. Tote bag 20 may also comprise two central portions 221, 222. When the tote bag 20 is in a collapsed position, central portions 221, 222 may be folded inside the tote bag 20. When a connection between the top portion 210 and the bottom portion 220 (for example, the joint 140 discussed above with regard to FIG. 1) is released, the tote bag 20 may expand to its full position.

Note that FIG. 2 also depicts optional wheels 230 that may be included in tote bag 20 so that if the tote bag is heavy or otherwise uncomfortable to carry (for example, if the tote bag 20 is in an extended position and is full). Such wheels 230 may be retracted when not in use.

Figure 3:
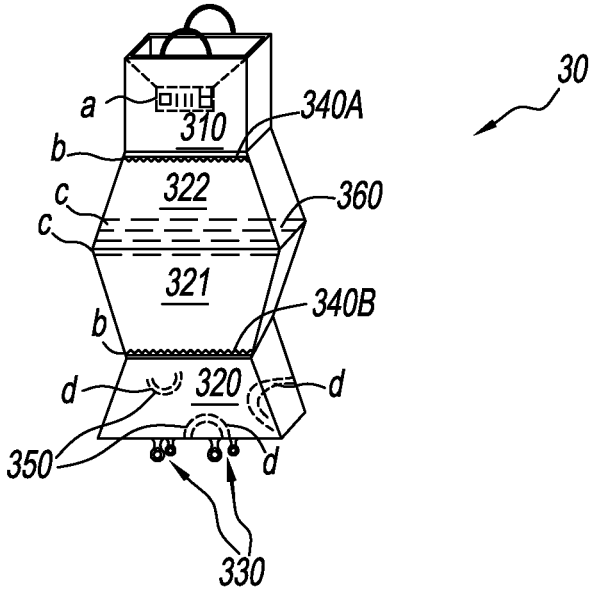
FIG. 3 illustrates an improved tote bag in an expanded position, in accordance with some embodiments of the present invention.

With reference to FIG. 3, a tote bag 30 in an extended position will now be discussed. Tote bag 30 may comprise—similar to that discussed above with regard to FIG. 2—a top portion 310, a bottom portion 320, and two central portions 321, 322. Bottom portion 320 may comprise one or more retractable wheels 330, as well as cavities 350 into which retractable wheels 330 may be retracted. Tote bag 30 also illustrates fastener 340A and fastener 340B. Fastener 340A may be disposed on the bottom of the top portion 310, and fastener 340B may be positioned at the top of the bottom portion 320. Fastener 340A and 340B may mate or otherwise connect (for example, may be two sides of a zipper, two elements of a snap, hook-and-loop fastener, etc.) and when connected may thereby hold the tote bag 30 in a retracted position. When not connected, the tote bag 30 may be allowed to be extended into its full position.

Tote bag 30 may further comprise a bottom a floor panel 360. Floor panel 360 may be positioned between the two central portions 321, 322 such that when the tote bag 30 is in a collapsed position the floor panel 360 may rest on the bottom of the bottom portion 320. Floor panel 360 may comprise a solid panel, a fabric panel, mesh, straps, or any other material or configuration suitable to separate the tote bag 30 into various compartments.

Figure 4:
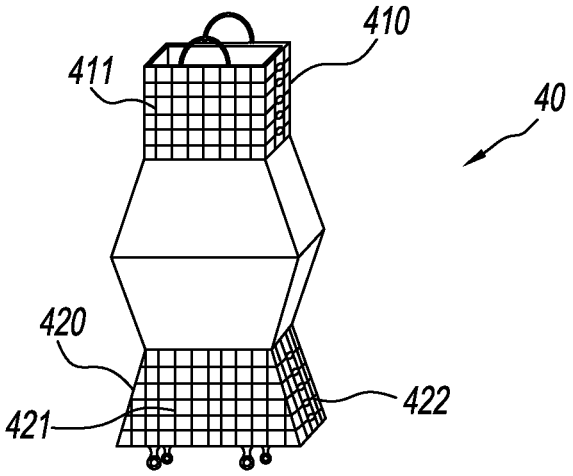
FIG. 4 illustrates an improved tote bag in an expanded position illustrating an exemplary internal frame, in accordance with some embodiments of the present invention.

It is contemplated that tote bags in accordance with some embodiments of the present invention may comprise some sort of internal frame, which may provide stability and rigidity to the tote bag, and may also support the tote bag when in an extended position. With reference to FIG. 4, a tote bag 40 may be seen with various frame elements. Specifically, the tote bag 40 may comprise a top portion 410 which in turn may comprise a frame component 411. Frame component 411 may be formed from any suitable material, including rigid plastic, steel, composite, wood, wire, alloy, or any other material. Tote bag 40 may further comprise a bottom portion 420, which in turn may comprise frame component 421. Note that frame component 421, while formed from a rigid material, may include one or more joints or pivots 422 so that the frame can be folded, partially collapsed, or otherwise manipulated.

Figure 5:
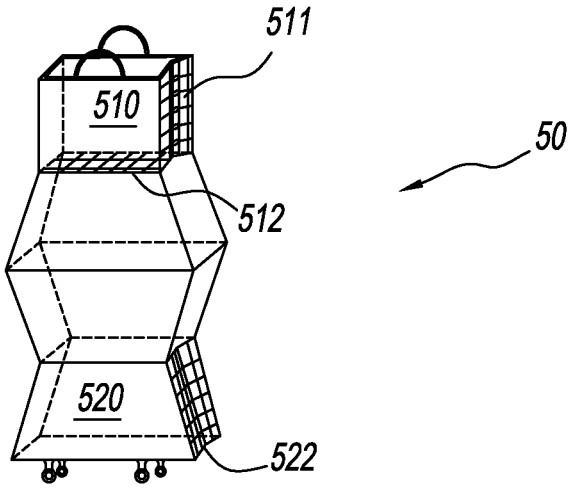
FIG. 5 illustrates an improved tote bag in an expanded position illustrating an exemplary internal frame, in accordance with some embodiments of the present invention.

FIG. 5 illustrates a tote bag 50 with internal frame components. Specifically, the tote bag 50 may comprise a top portion 510 which in turn may comprise a frame component 511. Top component 510 may also comprise a bottom frame element 512. Frame component 511 may be formed from any suitable material, including rigid plastic, steel, composite, wood, wire, alloy, or any other material. Tote bag 50 may further comprise a bottom portion 520, which in turn may comprise frame component 522. Note that frame component 522 may include one or more joints or pivots so that the frame can be folded, partially collapsed, or otherwise manipulated. With reference to FIG. 5, the frame components 511 and 522 may be seen in a partially folded arrangement in order to illustrate such functionality.

Figure 6:
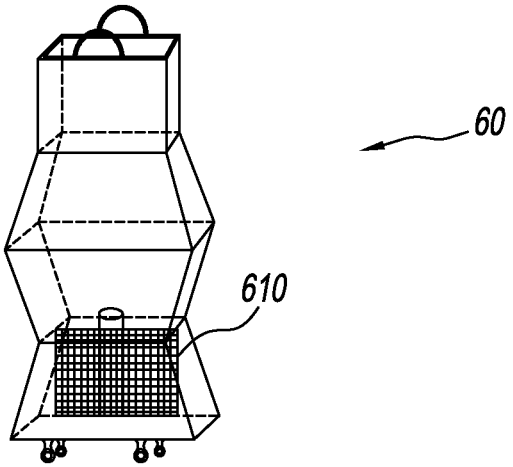
FIG. 6 illustrates an improved tote bag in an expanded position illustrating an exemplary internal frame, in accordance with some embodiments of the present invention.

With reference to FIG. 6, a tote bag 60 with an internal expandable frame component 610 in accordance with some embodiments of the present invention will now be discussed. Tote bag 60 may comprise an internal expandable frame component 610. Expandable frame component 611 may be positioned on (and may be, but not necessarily attached to) the bottom portion of tote bag 60

Figure 7A:
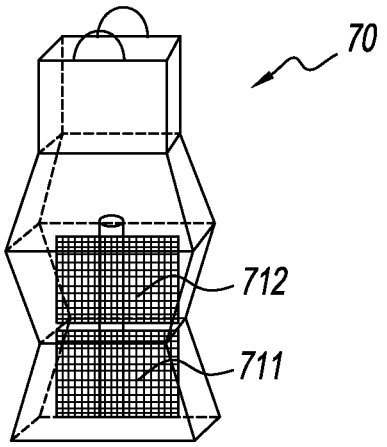
FIG. 7A illustrates an improved tote bag in an expanded position illustrating an exemplary internal frame, in accordance with some embodiments of the present invention.
Figure 7B:
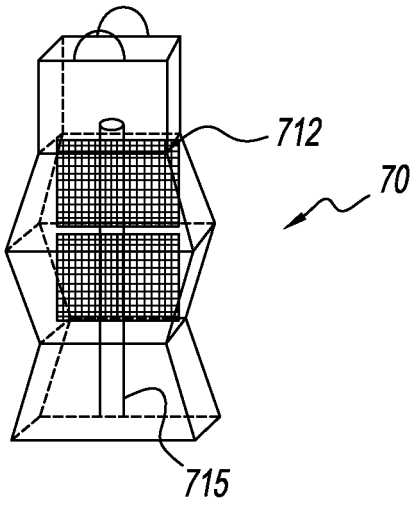
FIG. 7B illustrates an improved tote bag in an expanded position illustrating an exemplary internal frame, in accordance with some embodiments of the present invention.
Figure 7C:
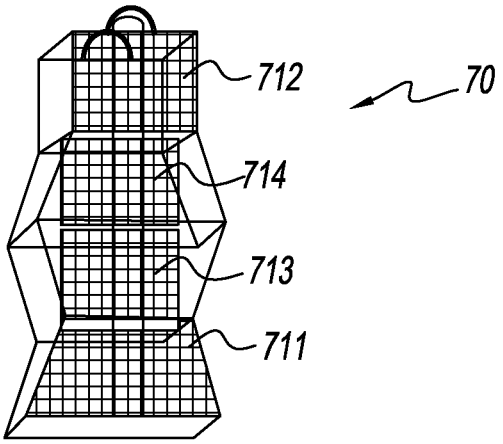
FIG. 7C illustrates an improved tote bag in an expanded position illustrating an exemplary internal frame, in accordance with some embodiments of the present invention.

With reference to FIGS. 7A-7C, expansion of an expandable frame component 710 in accordance with some embodiments of the present invention will now be discussed. Expandable frame component 710 may be expanded as the tote bag 70 is expanded, thereby providing an amount of rigidity as the tote bag 70 is expanded. Tote bag 70 may comprise multiple panels 711, 712, 713, 714 that may be connected along a column 715. The panels 711, 712, 713, 714 may be configured to telescope out of each other as the column 715 is extended, thereby providing some rigidity or support to the tote bag 70 when in the extended position.

Figure 8:
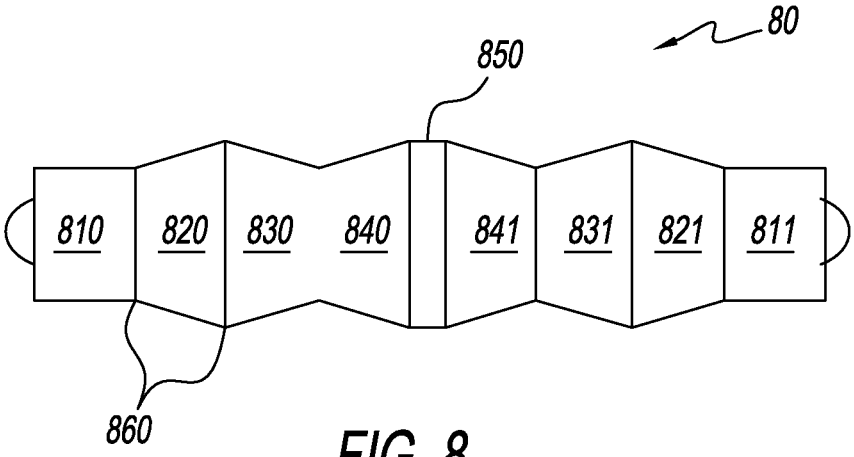
FIG. 8 illustrates an exemplary arrangement of exterior panels of a tote bag, in accordance with some embodiments of the present invention.

With reference to FIG. 8, a covering material 80 of a tote bag in accordance with some embodiments of the present invention will now be discussed. Material 80 may be, in accordance with some embodiments (but not necessarily all embodiments) of the present invention formed from a single piece of material, The material 80 may be cut, formed, or otherwise sized such that it forms the panels that will be collapsed inside and outside of the tote bag when assembled. For example, material 80 may comprise sides of a top panel 810, 811 as well as sides of central portions 820, 821 and 830, 831. Material 80 may also comprise a bottom portion 850. Note that it is also contemplated that, in order to provide for easy folding and otherwise collapsing or expansion of the tote bag, a fold line 860 may be present between each panel. Fold line 860 may comprise a line of weakness, hinge point, partial cut, or any other sort of modification that may permit, assist, encourage or control any folding of the panels.

Figure 9:
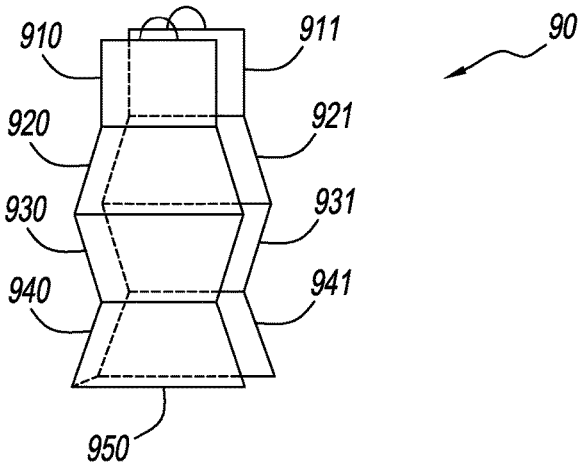
FIG. 9 illustrates an exemplary arrangement of exterior panels of a tote bag, in accordance with some embodiments of the present invention.

FIG. 9 illustrates a covering material 90 positioned in an arrangement similar to that of an extended tote bag, in order to illustrate how the material 90 may line up with a tote bag. Again, material 90 may comprise sides of a top panel 910, 911 as well as sides of central portions 920, 921 and 930, 931. Material 90 may also comprise a bottom portion 950.

Figure 10:
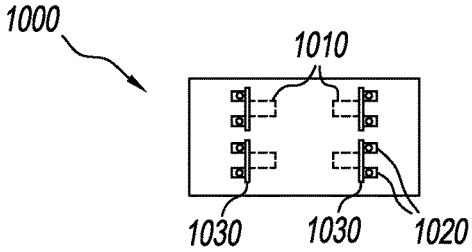
FIG. 10 illustrates a bottom surface of a tote bag equipped with optional wheels in a retracted position, in accordance with some embodiments of the present invention.

With reference to FIGS. 10-18, the bottom panel or surface of a tote bag in accordance with some embodiments of the present invention will now be discussed. FIG. 10 illustrates a bottom view of a tote bag 1000, showing a bottom surface with optional wheels 1010 in a retracted position. Tote bag may comprise one or more wheels 1010, which may be disposed on a bottom surface of tote bag. Wheels may be retractable such that when the tote bag is used in a collapsed position, the wheels may not present or protruding from the bottom. For example, wheels may be attached to a bottom surface of a tote bag by attachments 1020, but may be positioned on a hinge 1030. In accordance with some embodiments of the present invention, hinge 1030 may be spring loaded or otherwise biased into an open or closed position. With reference to FIG. 10, the wheels may be attached to a solid back surface 1010, that when the wheels are retracted, may provide the bottom panel of the tote bag with a generally solid, smooth, bottom panel.

Figure 11:
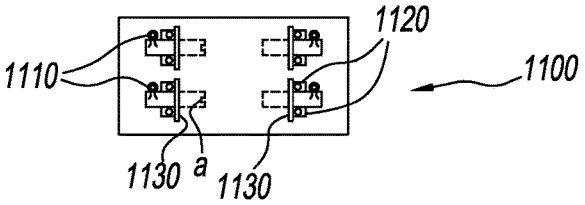
FIG. 11 illustrates a bottom surface of a tote bag equipped with optional wheels in an extended position, in accordance with some embodiments of the present invention.

With reference to FIG. 11, wheels may 1110 may be shown in an open or protruding position. Wheels 1110 may again be attached to the bottom panel of the tote bag by fasteners 1120, and may pivot about a hinge 1130 that may be biased. It is further contemplated that one or more switches or selectors maybe utilized to open and/or close the wheels from the retracted position. Note that it is also contemplated that a single selector maybe used to move the wheels from one position to another—for example, from a closed to an open position—but returning the wheels to the closed position may be a manual task.

Figure 13:
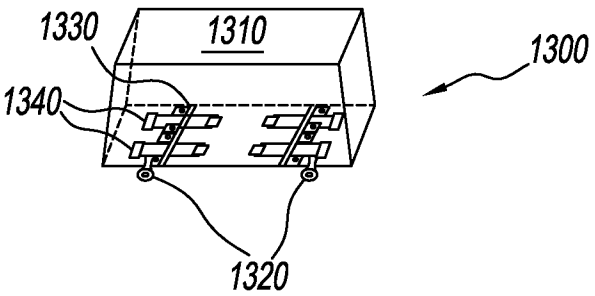
FIG. 13 illustrates a bottom section of a tote bag equipped with optional wheels in an extended position, in accordance with some embodiments of the present invention.
Figure 12:
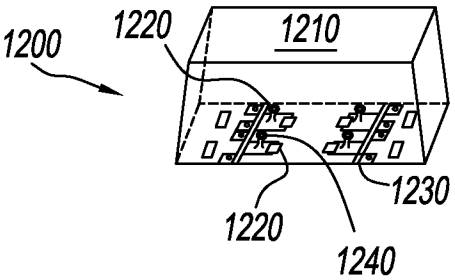
FIG. 12 illustrates a bottom section of a tote bag equipped with optional wheels in a retracted position, in accordance with some embodiments of the present invention.

FIGS. 12 and 13 illustrate a bottom section of a tote bag 1210, 1310 with wheels in a retracted position (FIG. 12) and in an extended position (FIG. 13). FIG. 12 depicts a bottom portion 1210 of a tote bag with a plurality of wheels 1220 folded into the cavity or body of the bottom section 1210. Wheels 1220 may be attached to a pivot 1230, which may be biased into an open or closed position. In order to hold wheels 1220 in a retracted position, a latch 1240 may be utilized. Latch 1240 may be of any sort of latch known in the art, and may be connected to a central switch or selector so that all wheels may be released substantially simultaneously.

With reference to FIG. 13, bottom portion 1310 of a tote bag may again comprise a plurality of wheels 1320 depicted in an open position. Again, wheels 1320 may be mounted or otherwise attached to a pivot or hinge 1330 that may be biased. Bottom surface of the tote bag may comprise a latch 1340 of any sort known in the art to keep the wheels in an open position. As with FIG. 12, it is contemplated that latch 1340 may be connected to a central switch or selector so that all wheels may be expanded or retracted substantially simultaneously.

Figure 14A:
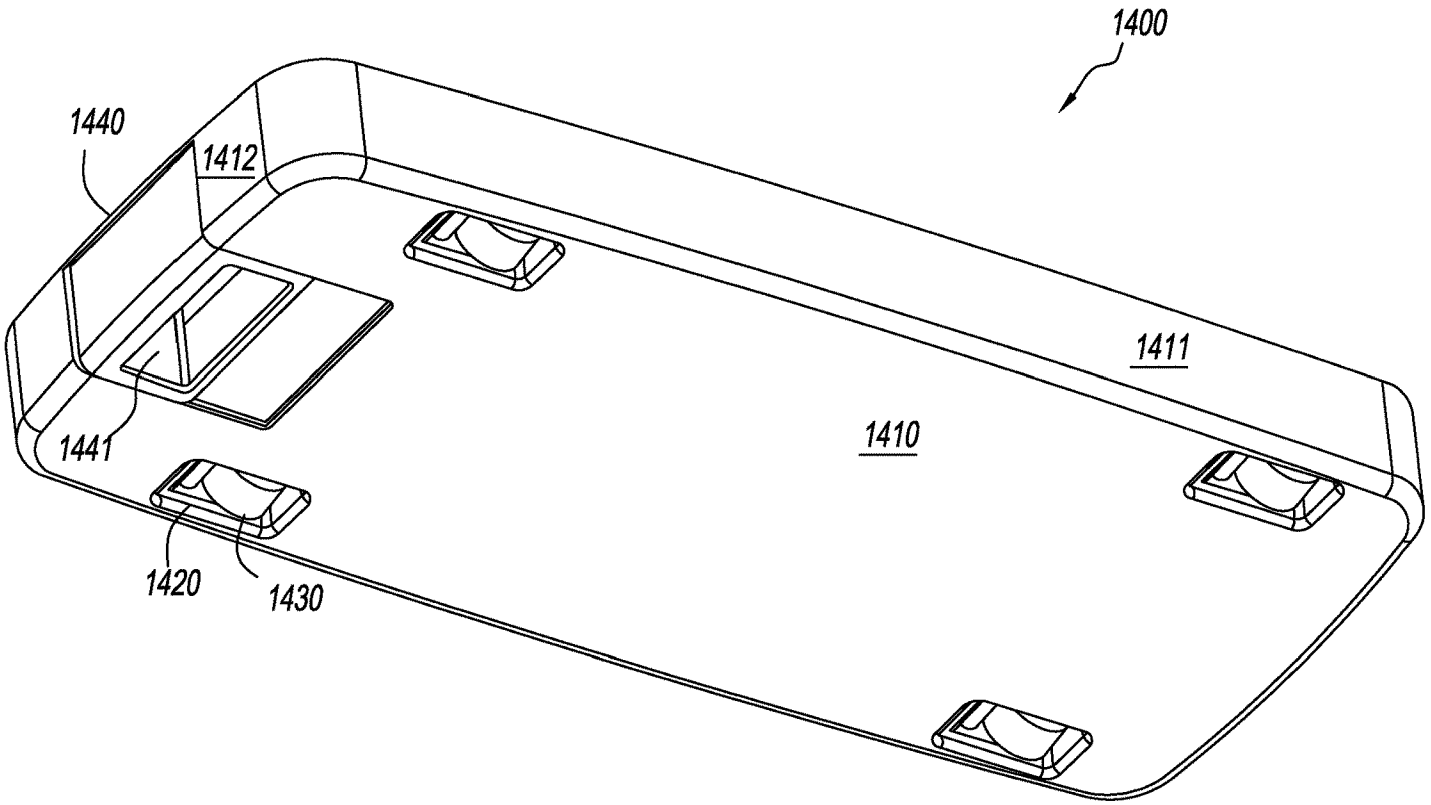
FIG. 14A illustrates a bottom section of a tote bag equipped with optional wheels in a retracted position, in accordance with some embodiments of the present invention.

With reference to FIG. 14A, a bottom panel 1400 of a tote bag in accordance with some embodiments of the present invention will now be discussed. Bottom panel 1400 may comprise a bottom surface 1410, as well as side surfaces 1411, 1412. Bottom panel 1400 may further comprise a plurality of cavities or indents 1420, in which wheels 1430 may reside when in a retracted position. Moreover, bottom panel 1400 may comprise a switch 1440 that may be disposed on any side surface (1411, 1412), but is shown on side surface 1412. Switch 1440 may be used to switch the wheels from a retracted position (as shown in FIG. 14) to an open position and back. Switch 1440 may include a grip 1441 that may be grasped by a user to move the switch 1440 laterally along the surface of the bottom panel. Note that while grip 1441 has been shown as an indent into which a user may insert his or her fingers to grip the switch, variations of the grip 1441 are contemplated. For example, rather than an indent the grip 1441 may comprise a protrusion. Similarly, although the switch 1440 is illustrated as requiring lateral movement along the bottom surface of the panel to switch the wheels from a retracted position to an open position and back, it is contemplated that switch 1440 may be a push button rather than a slide, and the button may be positioned on the bottom or side of the bottom panel 1400.

Figure 14B:
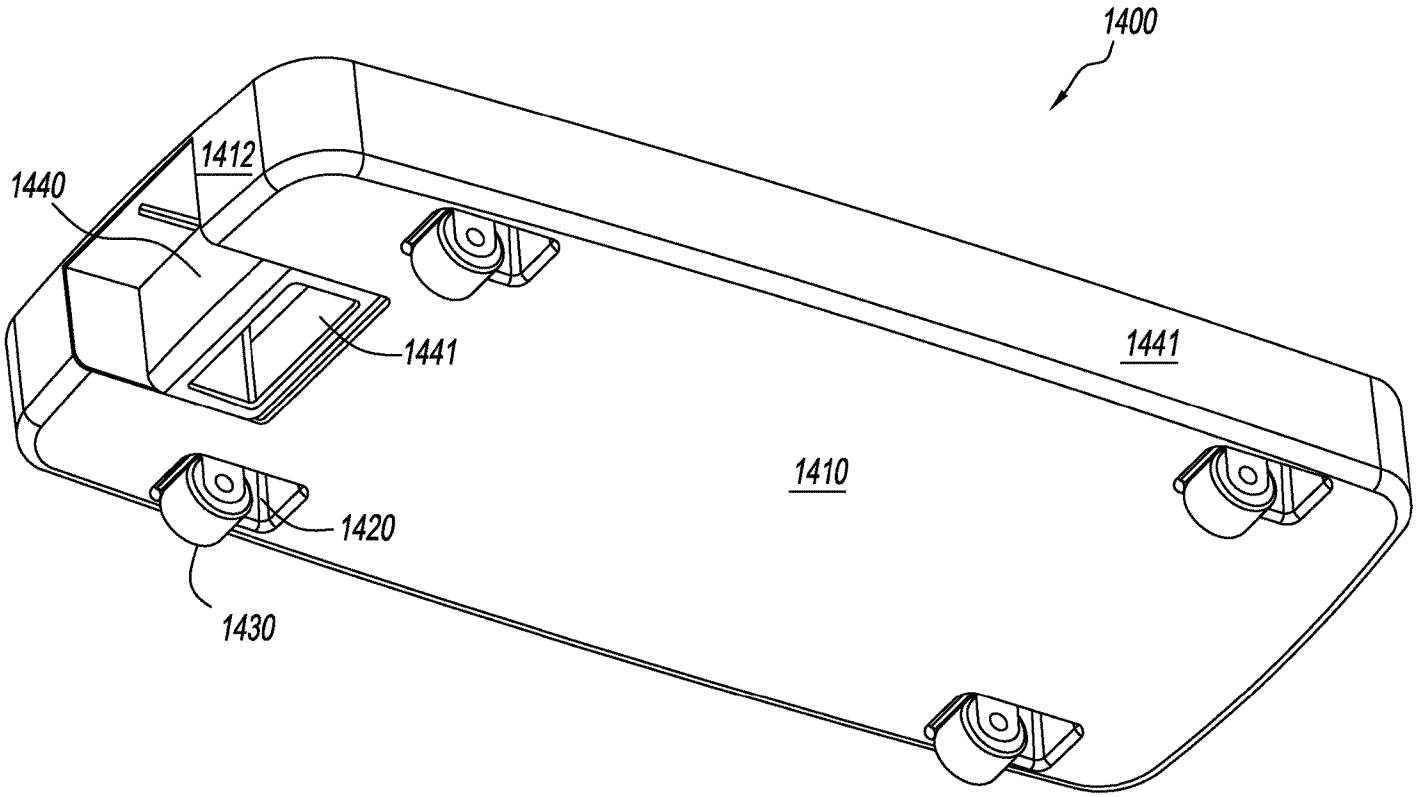
FIG. 14B illustrates a bottom section of a tote bag equipped with optional wheels in an extended position, in accordance with some embodiments of the present invention.

While FIG. 14A illustrates a bottom panel of a tote bag with wheels in a retracted position, FIG. 14B illustrates a bottom panel of a tote bag with wheels in an extended or open position, in accordance with some embodiments of the present invention. With reference to FIG. 14B, bottom panel 1400 may comprise a bottom surface 1410, as well as side surfaces 1411, 1412. Bottom panel 1400 may further comprise a plurality of cavities or indents 1420, in which wheels 1430 may reside when in a retracted position. As shown in FIG. 14B, however, wheels 1430 may be seen extending from the cavities 1420. Moreover, bottom panel 1400 may comprise a switch 1440 that may be disposed on any side surface (1411, 1412), but is shown on side surface 1412. Switch 1440 may be used to switch the wheels from a retracted position (as shown in FIG. 14A) to an open position (as shown in FIG. 14B) and back.

Figure 15A:
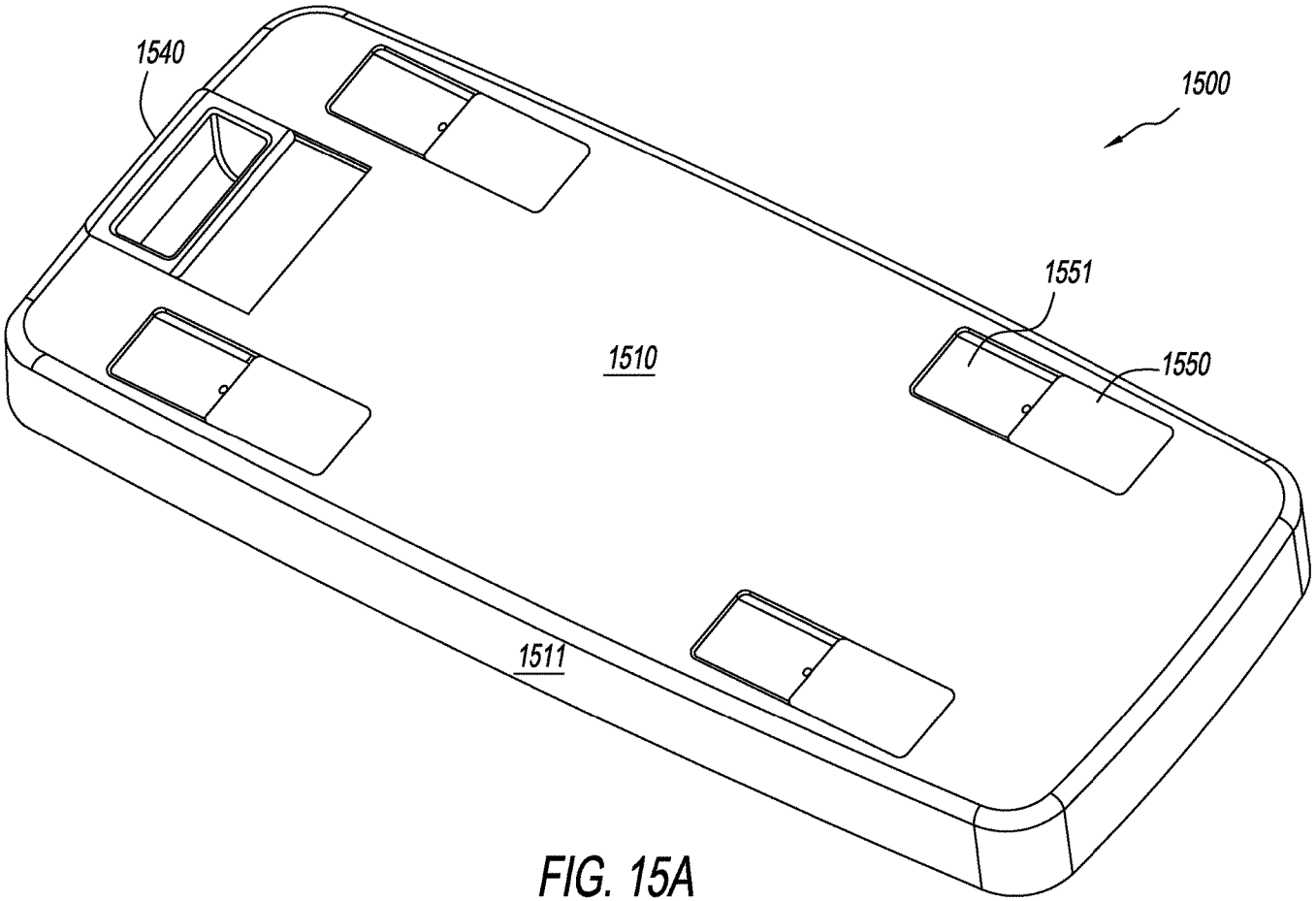
FIG. 15A illustrates a bottom section of a tote bag equipped with optional wheels in a retracted position, in accordance with some embodiments of the present invention.
Figure 15B:
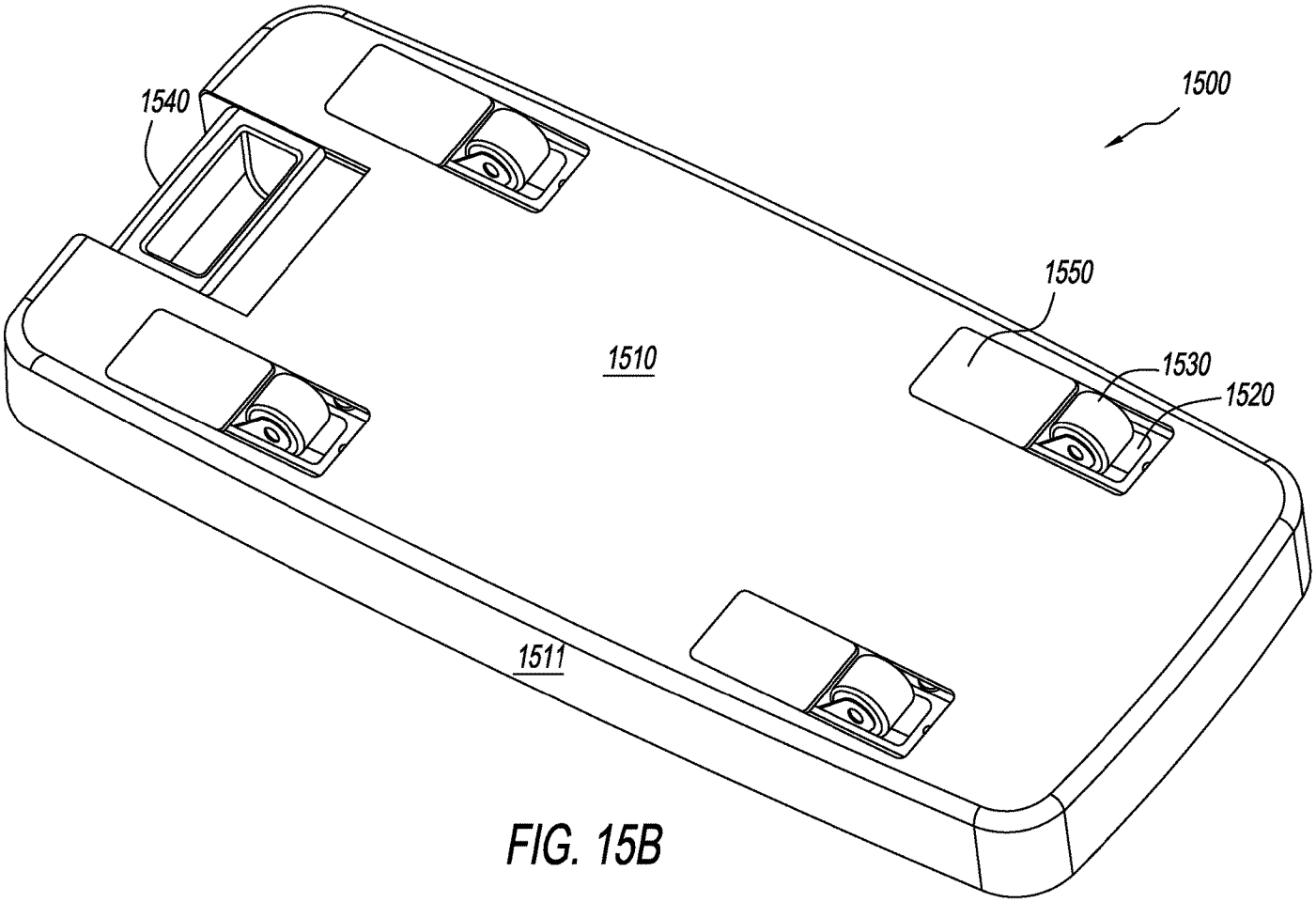
FIG. 15B illustrates a bottom section of a tote bag equipped with optional wheels in an extended position, in accordance with some embodiments of the present invention.

With reference to FIGS. 15A and 15B a bottom panel of a tote bag 1500 comprising a bottom surface 1510 and side surfaces 1511. Bottom panel 1500 may further comprise switch 1540 that may be used to select by the user a position of the wheels (either retracted or open). With reference to FIG. 15A, when the wheels are in a retraced a door 1550 may enclose the wheels. Note that while FIGS. 14A and 14B illustrated wheels that pivot about a hinge, FIGS. 15A and 15B depict wheels that are raised or lowered from the cavities in which they reside. Accordingly, doors 1550 may be used to close the cavity when the wheels are retracted to provide a smooth, substantially flat bottom surface of the tote bag. Note that proximate to doors 1550, the bottom surface may include a smaller indentation 1551 into which doors 1550 may slide when the wheels are in an open position. Note that switch 1540 is shown in a closed position.

With reference to FIG. 15B, the wheels 1530 are depicted in an open position. Doors 1550 are slide away from the wheel cavity 1520 and into the indentation 1551. Note that switch 1540 is shown in an open position, with the switch 1540 pushed laterally towards the bottom panel 1500.

Figure 16A:
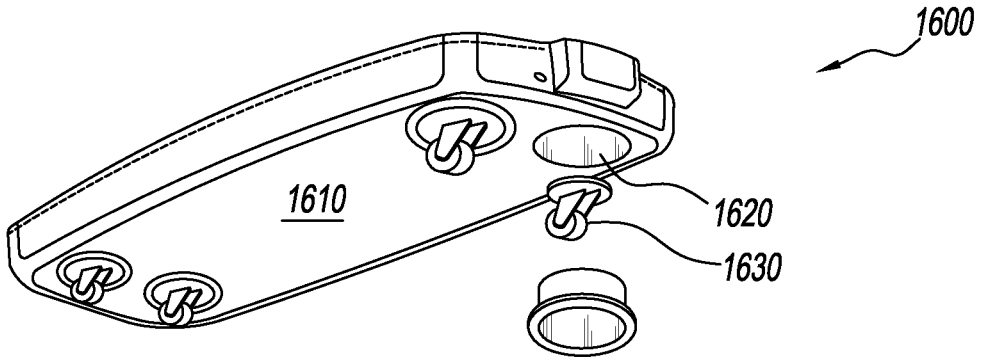
FIG. 16A illustrates a perspective view of a bottom section of a tote bag equipped with optional wheels, in accordance with some embodiments of the present invention.
Figure 16B:
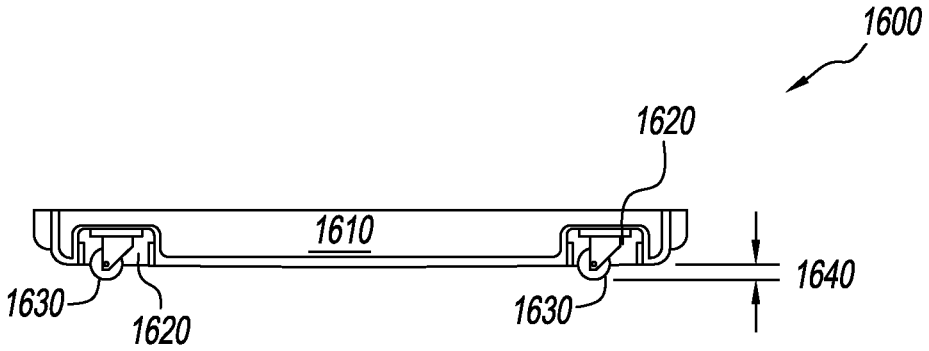
FIG. 16B illustrates a side view of a bottom section of a tote bag equipped with optional wheels, in accordance with some embodiments of the present invention.

So far, the optional wheels of the tote bag have been discussed as having the ability to retract out of the way. With reference to FIGS. 16A and 16B, a bottom panel 1600 of a tote bag will now be discussed in which wheels may be rigidly fixed in a useable position. Bottom panel 1600 may comprise a bottom surface 1610 that may in turn comprise one or more cavities 1620. One or more wheels 1630 may be disposed in one or more cavities 1620. Note that wheels may be rigidly fixed, or may have limited caster ability, or may be full swivel casters. With reference to FIG. 16B a side view of bottom panel 1600 may be seen. Again, bottom panel 1600 may comprise one or more cavities 1620 and one or more wheels 1630 disposed in cavities 1620. The side view depicted in FIG. 16B shows that wheels 1630 extend a distance 1640 beyond the bottom surface of the bottom panel. This clearance may be sized sufficient to provide ground clearance while not having the wheels protrude from the bottom panel so much as to be inconvenient or in the way of normal tote bag use.

Figure 17:
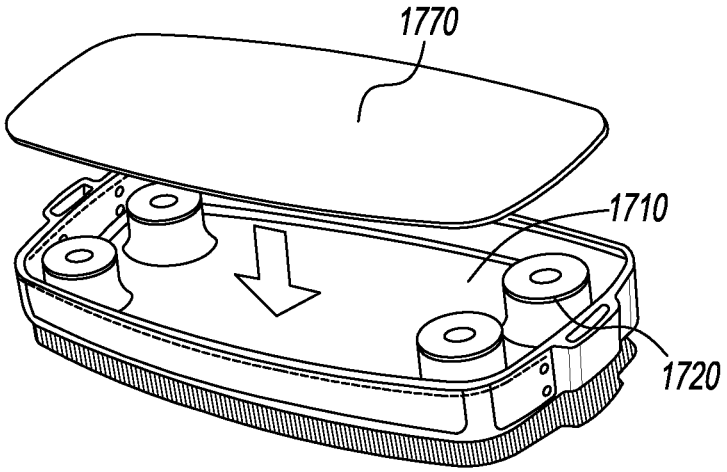
FIG. 17 illustrates a view of a bottom section of a tote bag equipped with optional wheels, in accordance with some embodiments of the present invention.

Several ways to attach the wheels to the tote bag are contemplated by present invention. Earlier figures depicted the wheels attached to a pivot or hinge. FIGS. 16 and 17 show wheels that may be individually attached inside of individual cavities. FIG. 18 depicts an arrangement wherein wheels may be attached to a panel that is then inserted into a second panel with one or more cavities. Each of these configurations—and any other variation, deviation, or modification therefrom—are contemplated by the present invention.

FIG. 17 illustrates a bottom panel 1700 of a tote bag, showing the inside section of the wheel cavities and bottom surface. Bottom panel 1700 may comprise a bottom surface 1710 in which may be extruded portions 1720. Extruded portions 1720 may from, when viewed from the bottom, the cavities into which the wheels may be disposed. In order to provide a smooth surface in the bottom of the tote bag, a floor panel 1770 may be used. Floor panel 1770 may be sized to fit inside the bottom panel 1700 and sit atop the extruded portions 1720.

Figure 18A:
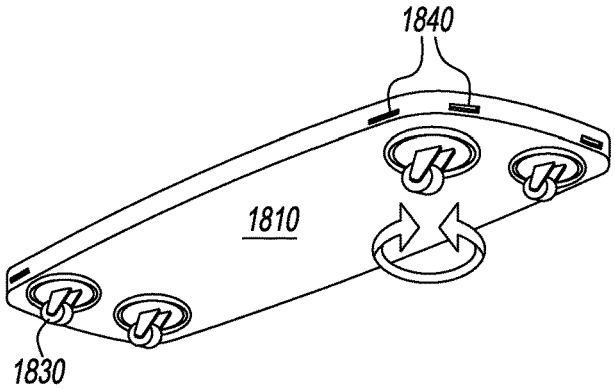
FIG. 18A illustrates a bottom platform that may be used with a tote bag equipped with optional wheels, in accordance with some embodiments of the present invention.

FIG. 18A illustrates a panel 1810 onto which one or more wheels 1830 may be attached. Again, wheels may be rigidly attached, or may have limited for full caster abilities. Panel 1810 may further comprise attachments 1840. Attachments 1840 may be hooks, latches, or any other sort of fastener used to attach multiple items. Attachments 1840 may be used to set the height of the panel 1810—and therefore the wheels—in a bottom panel 1811 of a tote bag.

Figure 18B:
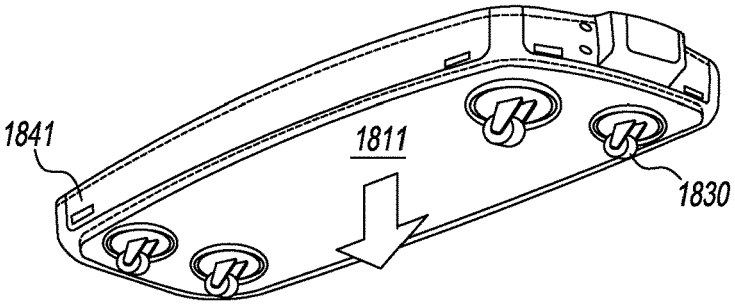
FIG. 18B illustrates a bottom platform that may be used with a tote bag equipped with optional wheels, in accordance with some embodiments of the present invention.
Figure 18C:
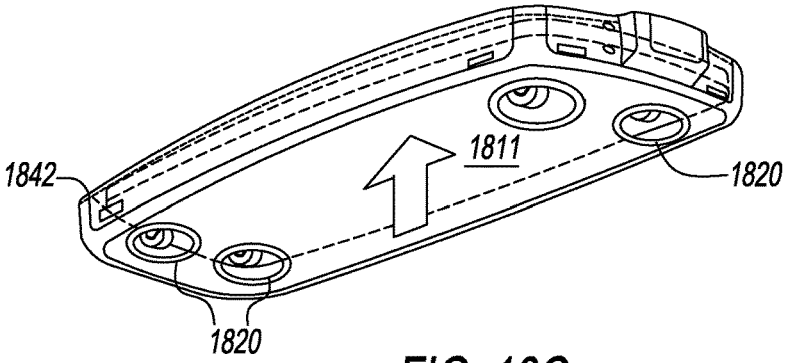
FIG. 18C illustrates a bottom platform that may be used with a tote bag equipped with optional wheels, in accordance with some embodiments of the present invention.

FIG. 18B shows a bottom platform 1811 into which the panel 1810 can be inserted. Bottom platform 1811 may comprise a plurality of openings 1820 into which the wheels 1830 may be inserted. Bottom platform 1811 may also comprise internal clips or fasteners 1841 that may selectively engage and disengage with attachments 1840. With reference to FIGS. 18B and 18C, internal clips or fasteners 1841, 1842, may allow the panel 1810 to be positioned at either a raised or lowered position in bottom platform 1811. The result of such modification of positioning is that the wheels 1830 may protrude from the cavities 1820 (when the panel 1810 is in the bottom position) or the wheels 1830 may be withdrawn into the cavities 1820 (when the panel 1810 is in the upper position).

Figure 19A:
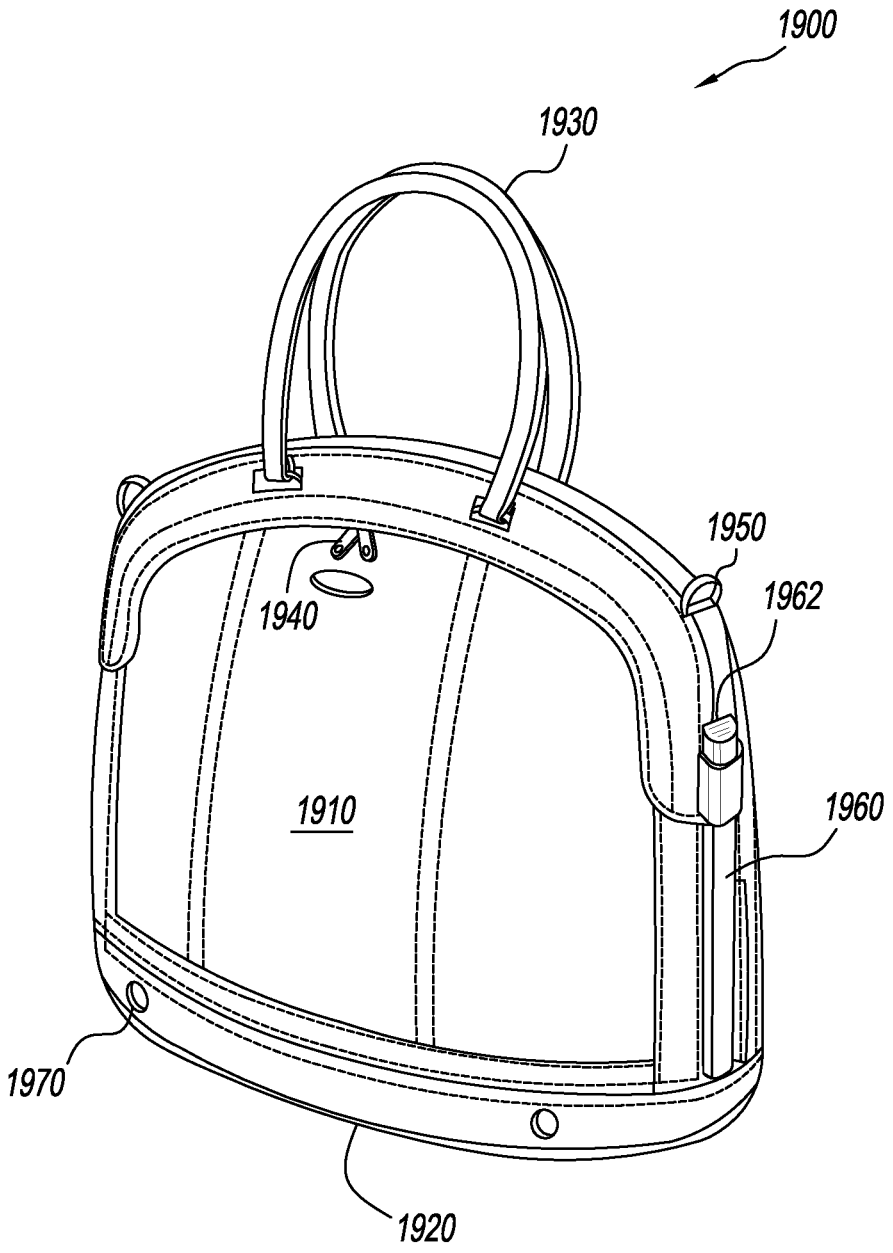
FIG. 19A illustrates a tote bag in a collapsed position, in accordance with some embodiments of the present invention.
Figure 19B:
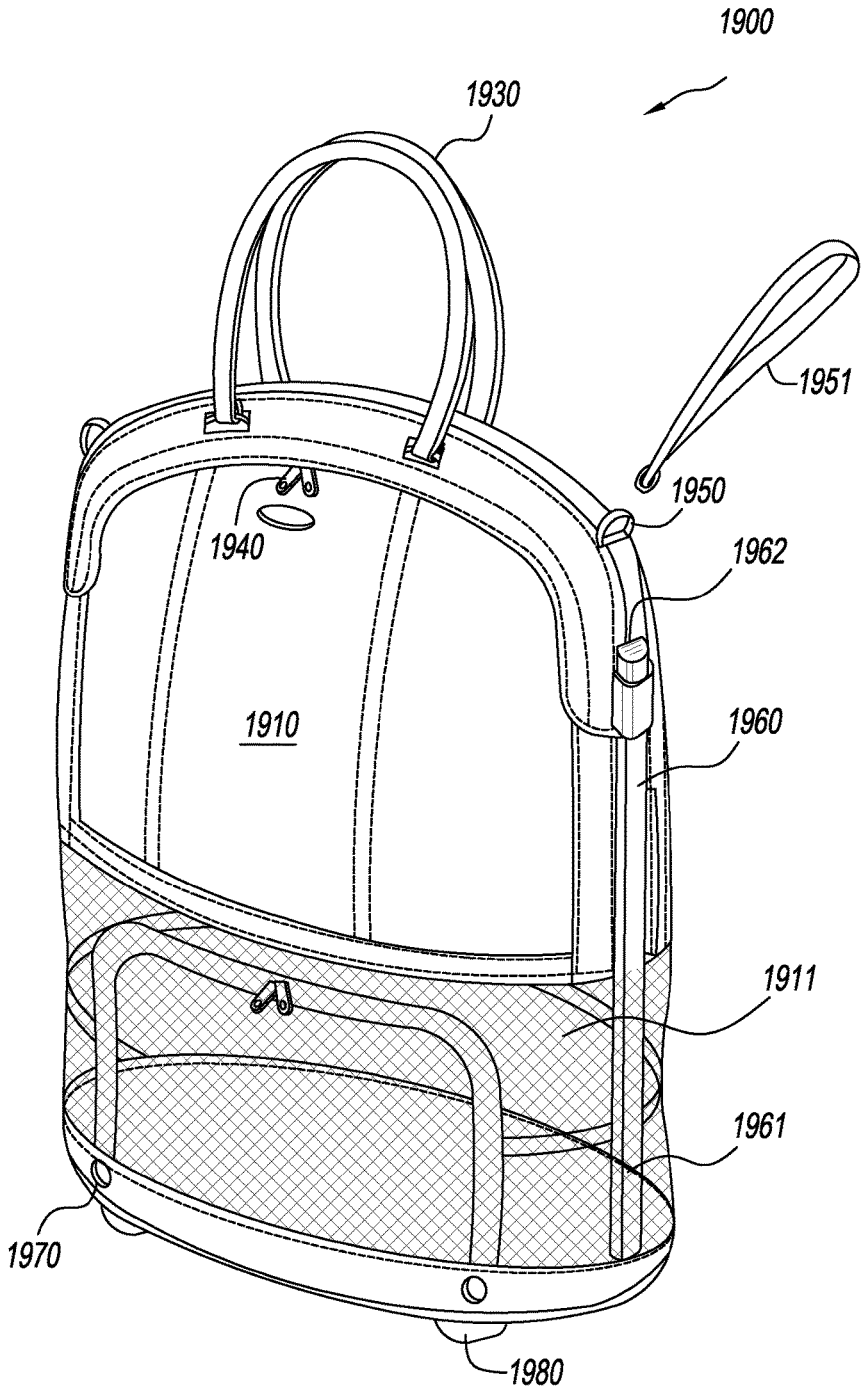
FIG. 19B illustrates a tote bag in an extended position, in accordance with some embodiments of the present invention.

With reference to FIGS. 19A and 19B, a tote bag 1900 in a collapsed and extended position will now be discussed. FIG. 19A depicts a tote bag 1900 comprising, in general, a main body 1910, a bottom surface or panel 1920, carrying elements 1930 (such as handles or straps), various pockets and storage elements 1940, attachment points for other straps or handles 1950, and a telescopic support bar 1960, and a control button 1970.

The telescopic support bar 1960 may comprise a switch or button 1962 that may be used to release the telescopic support bar 1960 so that it can extend to its full length. Telescopic support bar may be present on one side of the tote bag 1900, or on various sides or surfaces of the tote bag 1900.

Control button 1970 may be used to select a wheel position by a user. The wheels may be selectively positioned in a retracted or extended position. With reference to FIG. 19B the tote bag 1900 can be seen in an extended position, with an additional body cavity 1911 located below the main body 1910. The additional body cavity 1911 may be enclosed by a solid material (for example, canvas, nylon, leather, etc.) or may be enclosed by a mesh material, as depicted in FIG. 19B. The tote bag 1900 may remain in the extended position due to the telescopic support bar 1960, which may further comprise telescopic portion 1961, which may provide support to the additional body cavity 1911. Moreover, wheels 1980 may protrude from the bottom panel 1920 so that a fully laden tote bag may be easier to maneuver. Optional lanyard 1951 is also illustrated.

Comparing FIG. 19A to FIG. 19B, it can be seen that the tote bag 1900 can be quite compact and stylish when in a collapsed position, but can offer additional storage and cavity space when in an expanded position. Variations on the design of the tote bag 1900, as well as the different cavities, pockets, storage areas, zippers, etc. are contemplated by the present invention.

Figure 20A:
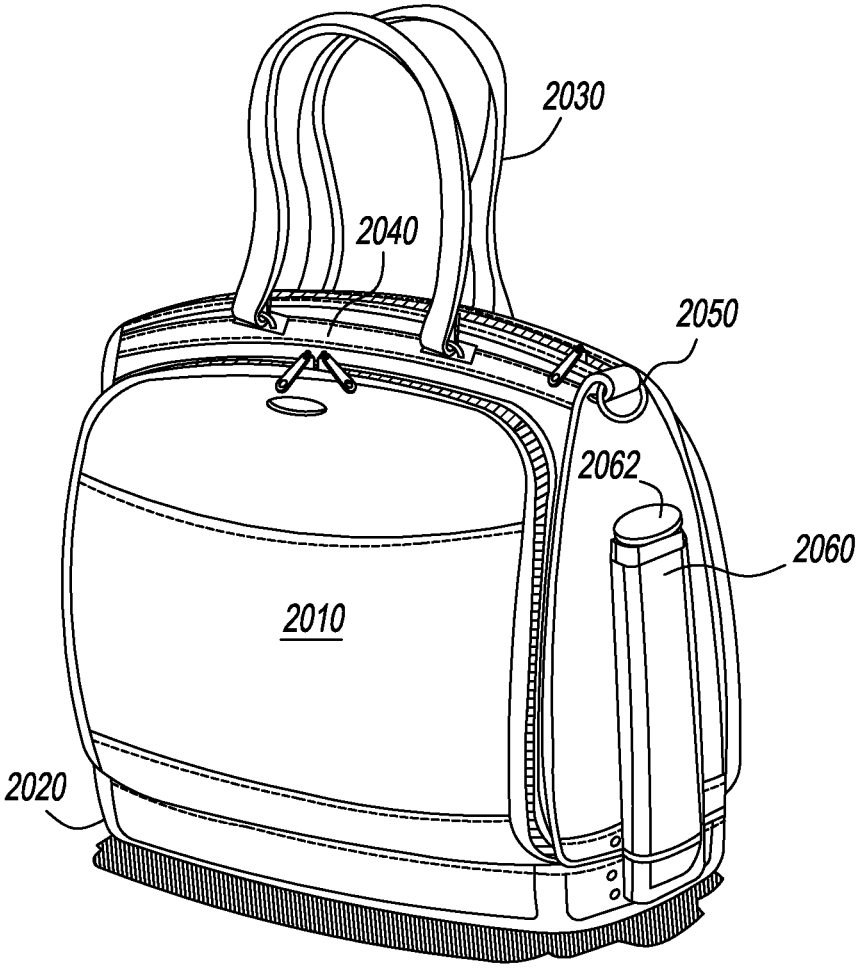
FIG. 20A illustrates a tote bag in a collapsed position, in accordance with some embodiments of the present invention.
Figure 20B:
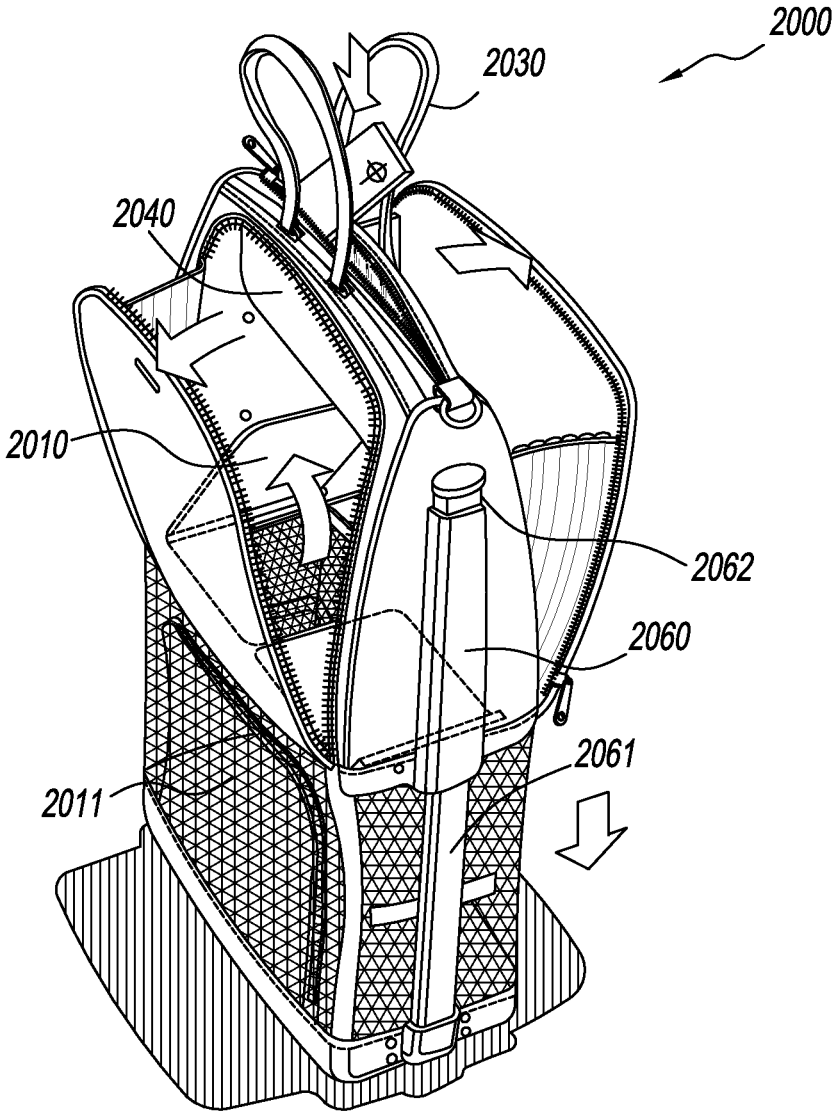
FIG. 20B illustrates a tote bag in an extended position, in accordance with some embodiments of the present invention.

FIGS. 20A and 20B similarly illustrate a tote bag 2000 in a collapsed position (as shown in FIG. 20A) and in an expanded position (as shown in FIG. 20B). FIG. 20A depicts a tote bag 2000 comprising, in general, a main body 2010, a bottom surface or panel 2020, carrying elements 2030 (such as handles or straps), various pockets and storage elements 2040, 2041, attachment points for other straps or handles 2050, and a telescopic support bar 2060.

The telescopic support bar 2060 may comprise a switch or button 2062 that may be used to release the telescopic support bar 2060 so that it can extend to its full length. Telescopic support bar may be present on one side of the tote bag 2000, or on various sides or surfaces of the tote bag 2000.

With reference to FIG. 20B the tote bag 2000 can be seen in an extended position, with an additional body cavity 2011 located below the main body 2010. The additional body cavity 2011 may be enclosed by a solid material (for example, canvas, nylon, leather, etc.) or may be enclosed by a mesh material, as depicted in FIG. 20B. The tote bag 2000 may remain in the extended position due to the telescopic support bar 2060, which may further comprise telescopic portion 2061, which may provide support to the additional body cavity 2011. Again, note that the tote bag 2000 may be designed with any number and arrangement of storage pockets or elements. Pockets and elements 2040, 2041, 2042 are depicted as exemplary only.

Figure 21A:
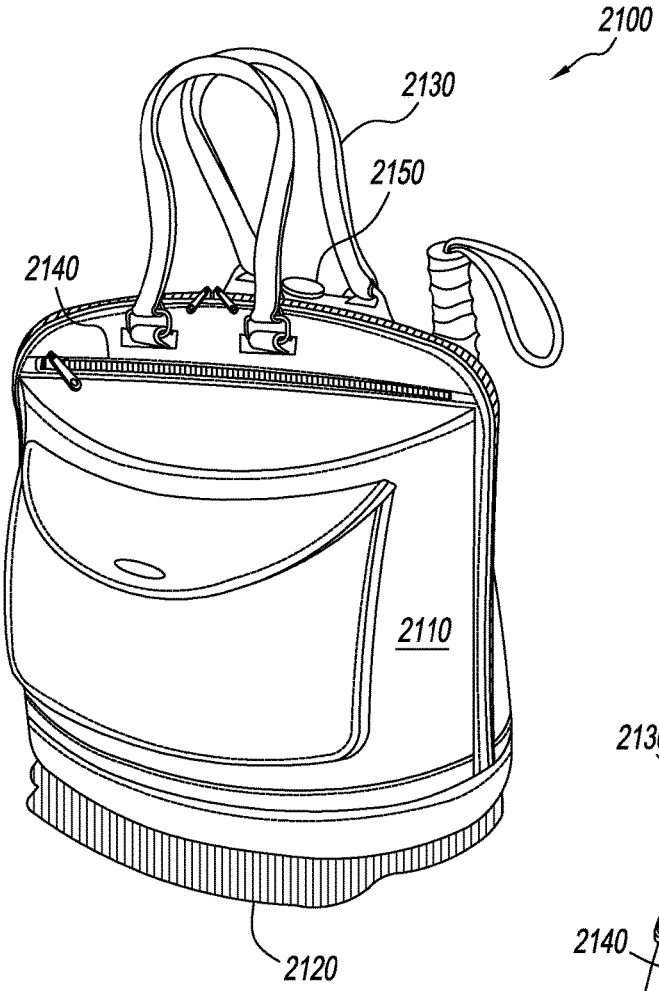
FIG. 21A illustrates a tote bag in a collapsed position, in accordance with some embodiments of the present invention.

With reference to FIGS. 21A-21D, a tote bag 2100 in a collapsed and extended position will now be discussed. FIG. 21A depicts a tote bag 2100 in a collapsed position, comprising, in general, a main body 2110, a bottom surface or panel 2120, carrying elements 2130 (such as handles or straps), various pockets and storage elements 2140, and a telescopic support bar 2150.

The telescopic support bar 2150 may comprise a switch or button 2151 that may be used to release the telescopic support bar 2150 so that it can extend to its full length. Telescopic support bar 2150 may be present on one side of the tote bag 2100, or on various sides or surfaces of the tote bag 2100.

Figure 21B:
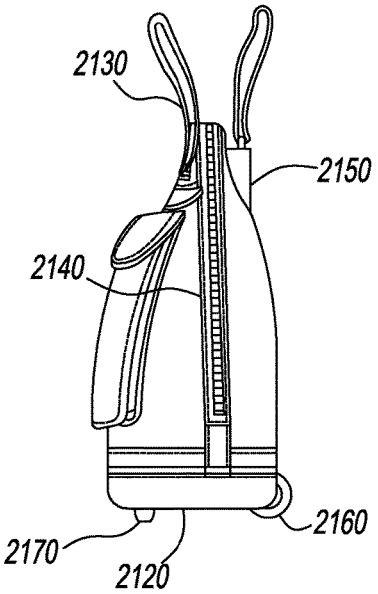
FIG. 21B illustrates a side view of a tote bag in a collapsed position, in accordance with some embodiments of the present invention.
Figure 21C:
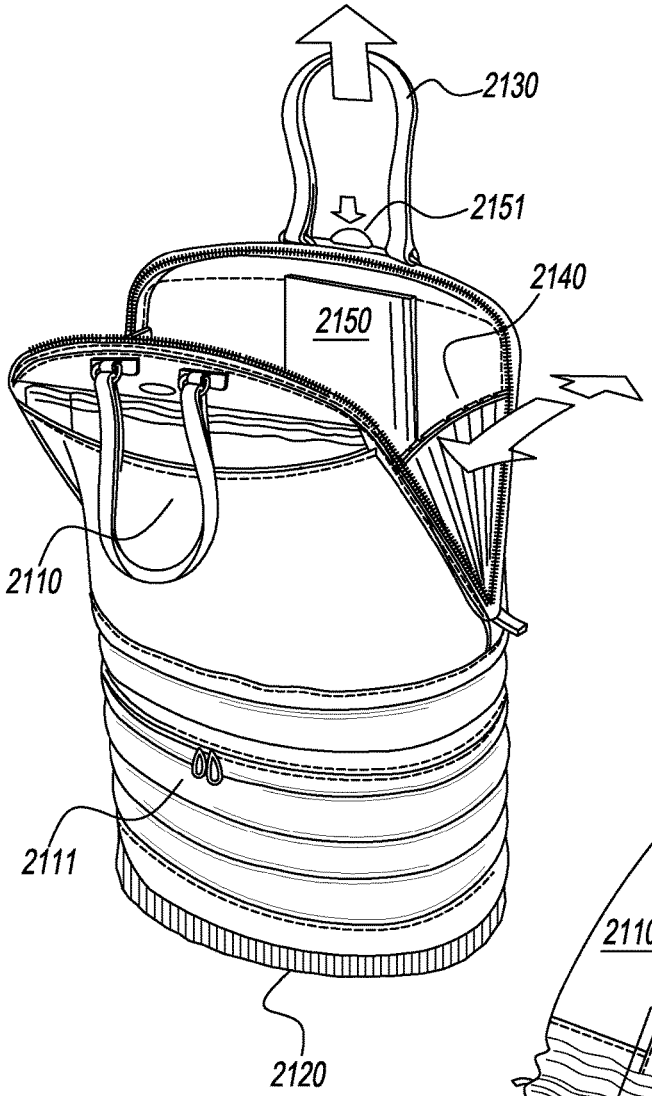
FIG. 21C illustrates a tote bag in an extended position, in accordance with some embodiments of the present invention.
Figure 21D:
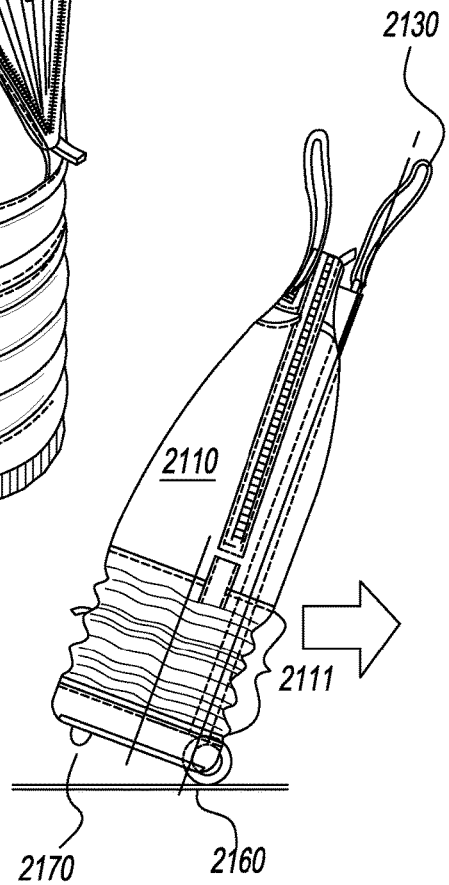
FIG. 21D illustrates a side view of a tote bag in an extended position, in accordance with some embodiments of the present invention.

With reference to FIG. 21C, the tote bag 2100 can be seen in an extended position, with an additional body cavity 2111 located below the main body 2110. The additional body cavity 2111 may be enclosed by a solid material (for example, canvas, nylon, leather, etc.) or may be enclosed by a mesh material. The tote bag 2100 may remain in the extended position due to the telescopic support bar 2150, which may further comprise telescopic portion (not illustrated), which may provide support to the additional body cavity 2011. Moreover, with reference to FIG. 21D, wheels 2160 may protrude from the bottom panel 2120 so that a fully laden tote bag may be easier to maneuver. Note that wheels 2160 may be positioned on only one side of the tote bag 2100, much like wheels on luggage, while the opposing side of the tote bag 2100 may be supported by a foot or other protrusion 2170.

Again, comparing FIG. 21A to FIG. 21C, it can be seen that the tote bag 2100 can be quite compact and stylish when in a collapsed position, but can offer additional storage and cavity space when in an expanded position. And again, variations on the design of the tote bag 2100, as well as the different cavities, pockets, storage areas, zippers, etc. are contemplated by the present invention.

Figure 22:
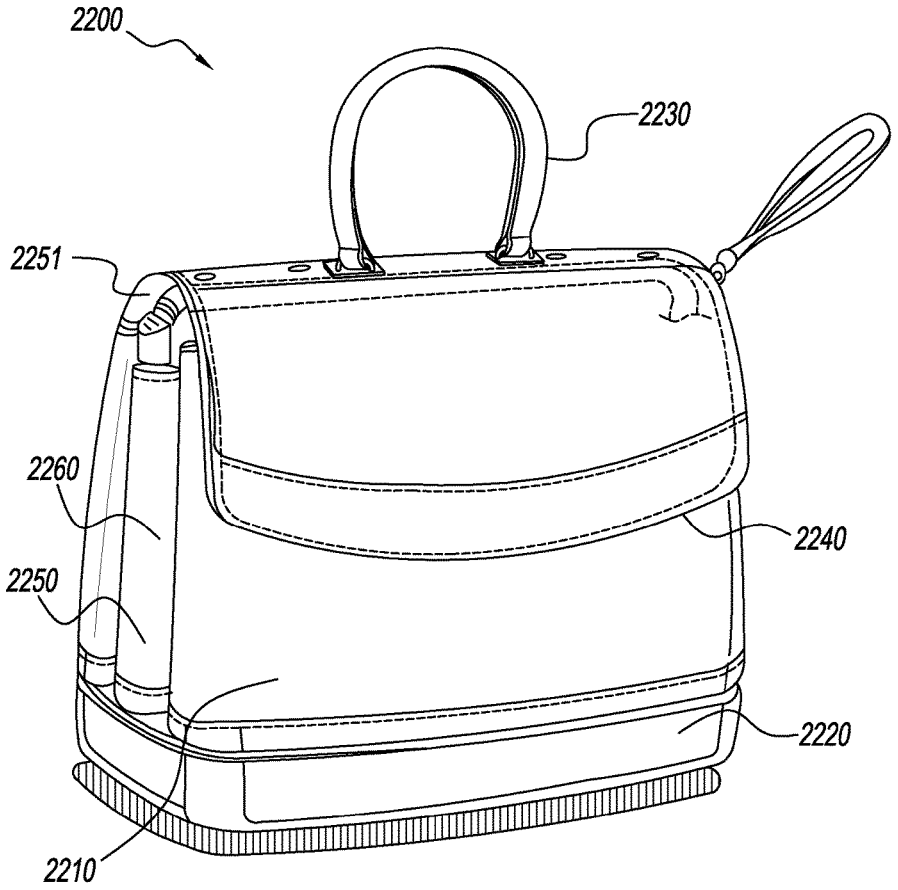
FIG. 22 illustrates a tote bag in a collapsed position, in accordance with some embodiments of the present invention.

It is noted above, and again emphasized, that tote bags in accordance with the present invention can take a variety of shapes and/or designs. FIG. 22 illustrates a tote bag 2200 shown in a collapsed position. Tote bag 2200 may be similar to a briefcase design, and may include various elements discussed above. Tote bag 2200 may comprise various telescopic supports 2250 that may be positioned on each side. Note that such telescopic supports 2250 may be covered by gusseted material 2260 to allow for expansion of the bag in different directions. The tote bag 2200 may further comprise a bottom panel 2220 that may be equipped with option wheels.

It will be understood that the specific embodiments of the present invention shown and described herein are exemplary only. Numerous variations, changes, substitutions and equivalents will now occur to those skilled in the art without departing from the spirit and scope of the invention. Accordingly, it is intended that all subject matter described herein and shown in the accompanying drawings be regarded as illustrative only, and not in a limiting sense, and that the scope of the invention will be solely determined by the appended claims.

What is claimed is:

1. A vertically expanding bag that is carried as a purse or tote when the bag is not expanded, and is wheeled when the bag is expanded, comprising:

a substantially rigid and substantially planar bottom panel;

an internal support connected to the bottom panel, the internal support capable of telescoping from a collapsed position to an extended position;

a collapsible pocket comprised of a flexible material connected to the bottom panel and the internal support, the collapsible pocket disposed such that it creates a collapsible cavity or pocket within and surrounded by the collapsible material when the internal support is telescoped into an extended position;

non-collapsible side walls that form a cavity or pocket, the non-collapsible side walls attached to the internal support;

a bottom surface in the cavity or pocket formed by the non-collapsible side walls, the bottoms surface separating the non-collapsing cavity or pocket from the collapsible pocket; and at least four wheels deployably attached to the substantially rigid and substantially planar bottom panel, the wheels configured that when deployed the vertically expanding bag sits in a substantially vertical position.

2. The vertically expanding bag of claim 1, further comprising:

one or more handles, straps, or other carrying elements attached to the non-collapsible side walls.

3. The vertically expanding bag of claim 1, wherein the internal support comprises one or more telescopic shafts.

4. The vertically expanding bag of claim 1, wherein the internal support comprises one or more nesting frameworks.

5. The vertically expanding bag of claim 1, further comprising one or more wheels attached to the substantially rigid and substantially planar bottom panel.

6. The vertically expanding bag of claim 5, wherein the substantially rigid bottom panel comprises a mechanism to raise and lower the one or more wheels.

7. The vertically expanding bag of claim 5, wherein the mechanism to raise and lower the one or more wheels is connected to the internal support, such that when the internal support is extended the one or more wheels are lowered, and when the internal support is retracted, the one or more wheels are raised.

8. The vertically expanding bag of claim 5, wherein the one or more wheels are raised or lowered together.

9. The vertically expanding bag of claim 5, wherein the one or more wheels are attached to a pivot such that the wheels may be folded into the substantially rigid and substantially planar bottom panel when not in use.

10. The vertically expanding bag of claim 5, wherein the substantially rigid and substantially planar bottom panel comprises one or more cavities into which the one or more wheels are attached.

11. The vertically expanding bag of claim 10, further comprising doors that cover the cavities when the one or more wheels are not in use.

12. A vertically expanding bag that is carried as a purse or tote when the bag is not expanded, and is wheeled when the bag is expanded, comprising:

a substantially rigid and substantially planar bottom panel, comprising:

one or more cavities formed in the bottom panel;

at least four wheels disposed inside the one or more cavities and deployably attached to the bottom panel, the wheels configured that when deployed the vertically expanding bag sits in a substantially vertical position; and a mechanism to raise and lower the one or more wheels between positions inside the cavity and positions extending from the cavity, such that in a lowered position the wheels may be used;

an internal support connected to the bottom panel, the internal support capable of telescoping from a collapsed position to an extended position;

a collapsible pocket comprised of a flexible material and connected to the bottom panel and the internal support, the collapsible pocket disposed such that it creates a collapsible cavity or pocket within and surrounded by the collapsible material when the internal support is telescoped into an extended position, the cavity or pocket formed by the non-collapsible side wall comprising a bottom surface, the bottoms surface separating the non-collapsing cavity or pocket from the collapsible pocket;

a non-collapsible pocket, comprised of:

side walls that form a cavity or pocket, the non-collapsible side walls attached to the internal support; and a bottom surface separating the non-collapsing cavity or pocket from the collapsible pocket.

13. The vertically expanding bag of claim 12, further comprising doors that cover the cavities when the one or more wheels are not in use.

* * * * *